United States Patent [19]

Umeya et al.

[11] Patent Number: 4,830,289

[45] Date of Patent: May 16, 1989

[54] CENTRIFUGAL FLUIDIZED GRINDING APPARATUS

[75] Inventors: Kaoru Umeya, Sendai; Kiyoshi Fujino, Ube, both of Japan

[73] Assignee: Ube Industries, Ltd., Ube; Kaoru Umeya, Sendai, both of Japan

[21] Appl. No.: 89,764

[22] Filed: Aug. 27, 1987

[51] Int. Cl.[4] ..... B02C 17/02

[52] U.S. Cl. ..... 241/57; 51/163.2; 241/80; 241/97; 241/176; 241/182

[58] Field of Search ..... 51/163.2; 241/57, 166, 241/80, 179, 97, 180, 171, 176, 172, 182

[56] References Cited

U.S. PATENT DOCUMENTS

| | | | |
|---|---|---|---|
| 442,055 | 12/1890 | Jordan | 241/176 X |
| 4,673,134 | 6/1987 | Barthelmess | 241/57 |

FOREIGN PATENT DOCUMENTS

| | | | |
|---|---|---|---|
| 435120 | 11/1926 | Fed. Rep. of Germany | 241/172 |
| 666249 | 10/1938 | Fed. Rep. of Germany . | |
| 707525 | 6/1941 | Fed. Rep. of Germany . | |
| 1607562 | 12/1969 | Fed. Rep. of Germany . | |
| 100564 | 8/1979 | Japan | 241/57 |
| 209649 | 12/1982 | Japan . | |
| 03650 | 1/1983 | Japan . | |
| 58-839 | 4/1983 | Japan . | |
| 82858 | 6/1983 | Japan . | |
| 82859 | 6/1983 | Japan . | |
| 125863 | 6/1987 | Japan . | |

OTHER PUBLICATIONS

"Grinding" by Saburo Kamei, issued by Sangyo Tosho Ltd. in Japan, pp. 235, 335, 336, Jun. 1, 1952.

"Development of Centrifugal Fluidized Mill for Fine Grinding" by Nobuaki Inoue, UBE Industries Ltd. , in Magazine "INTER" issued on Apr. 20, 1987 in Japan.

*Primary Examiner*—Mark Rosenbaum

*Attorney, Agent, or Firm*—Finnegan, Henderson, Farabow, Garrett & Dunner

[57] ABSTRACT

A centrifugal fluidized grinding apparatus having balls as a grinding medium therein, comprises a parting vessel having a vertical axis, composed of inner and outer vessel parts both forming a circumferential groove. The circumferential groove has a continuous and smooth surface and provides a completely open inner space allowing the grinding medium and starting materials to move freely through any part of the entire area of the inner space without encountering any obstacles. The groove has a generally ovoid profile with an upper part thereof cut away in a vertically cross-sectional view taken along a plane including the axis. The ovoid has a longitudinal axis intersecting the vertical axis at a position over the parting vessel. The inner and outer vessel parts are mounted for relative rotation about the vertical axis, in such a manner that the inner vessel part is rotated while the outer vessel part is stationary, or the latter is rotated in a reverse direction. The groove is covered, but the balls are forced to fly from a groove surface part, formed by the outer vessel part, to land tangentially on an opposite groove surface part, formed by the inner vessel part, in a parabolic flight course below the covering.

19 Claims, 6 Drawing Sheets

B: MATERIAL GROUND BY PRESENT INVENTION (400rpm x 1Hr)
C: MATERIAL GROUND BY PRIOR ART
A: STARTING MATERIAL
MATERIAL: ALUMINA
CUMULATIVE RESIDUE (%)
0
50
100
1
10
100
1000
PARTICLE SIZE (μm)

CENTRIFUGAL FLUIDIZED GRINDING APPARATUS

BACKGROUND OF THE INVENTION

1. Field of the Invention

The present invention relates to a grinding apparatus comprising a vertical parting vessel composed of an inner rotor part and an outer part forming a stator or another rotor rotating in a reverse direction relative to the inner rotor. The parting vessel generates a special centrifugal fluidization of steel balls used therein as the grinding medium to grind starting materials therein.

2. Description of the Related Art

Of the known grinding apparatuses, there are the tube mill type, vertical mill type, or the like. Among these conventional grinding apparatuses, is a vertical ball mill having a rotor forming an integrated vessel with a cover, in which rotor a grinding medium such as steel balls (hereinafter referred to as "balls") are circulated to grind starting materials by compression and/or impact and shearing in cooperation with the covered vessel.

Japanese Patent Unexamined Publications (KOKAI) Nos. 57-209649 and 58-3650 disclose vertical ball mills of the continuation type. For convenience of explanation herein, FIGS. 2*a* and FIG. 2*b* attached hereto show basic and general profiles of the disclosed ball mills, respectively.

FIG. 2*a* is a cross-sectional view of the vertical ball mill taken along a vertical plane including the vertical axis X of the mill. Numeral 1 denotes a rotational vessel symmetrical about the vertical axis and having a horizontal bottom surface B and a circumferential sloping side surface A, the diameter of which increases as the center of the diameter moves upwards along the vertical axis X. The vessel 1 is closed by a cover 3. The cover 3 has a circumferential concave portion in a ring form and a central planner portion integrated therewith. The concave portion opens downwardly and has a semi-circular profile in a vertical cross-sectional view. The vessel 1 is provided with a drive shaft 2 for rotating the vessel.

With this arrangement, the balls are forced to creep up the sloping surface A, due to rotation of the vessel 1, from the bottom surface, move along the inner surface of the concave ring portion, and then fall and strike the bottom surface B. This circulation of the balls is effected repeatedly in a cross-sectional view taken along any vertical plane including the vertical axis, while the vessel 1 rotates.

FIG. 2*b* is a cross-sectional view corresponding to FIG. 2*a* and showing another conventional vertical ball mill. This mill is substantially the same as that of FIG. 2*a* except for a configuration of a vessel 4. The vessel 4 has a circumferential groove portion and a central solid portion 5 of a truncated cone projecting upward. The inner circumferential surface A of the groove portion and the outer circumferential surface C of the central solid portion 5 form reversed cones projecting downwards in a cross-sectional view taken along a vertical plane including the axis X. The groove portion has a circumferential bottom surface B. According to the other ball mill, the balls fall from the concaved inner surface of the cover 3 to strike the sloping surface C and then bounce toward the bottom surface B.

According to the conventional ball mills as shown in FIG. 2*a* and FIG. 2*b*, grinding is effected mainly by the action of the balls sliding against the surface A of the rotational vessel 1. The sliding movement is divided into two components: one is an upward slide of the balls; and the other one is a slide of the balls caused by a difference between a velocity of the surface in a tangential direction and a velocity of the balls revolving about the vertical axis in a tangential direction.

In this connection, the surface A of the conventional vertical ball mill rotates in the same tangential direction as that in which the balls revolve, since the surface A forms an integral part of the rotary vessel 4. Under the circumstances, the difference in the tangential velocity between the surface A and the balls is not large, and as a result, the effect of the grinding by compression and/or impact and shearing due to the tangential velocity difference is low.

In addition, the rotations of the vessels 1 and 4 generate centrifugal forces which are imparted to the balls, and the balls are forced to creep up along the surface A due to the centrifugal force and store potential energy. With the ball mill of FIG. 2*a*, the potential energy, however, is almost lost or consumed when the balls fall to the bottom surface B from the ceiling surface of the cover 3, with the result that the balls have little energy to effect grinding at the surface B.

With the ball mill, as shown in FIG. 2*b*, the balls fall onto the sloping surface C from the ceiling surface of the cover 3 and rebound from the surface C, thus obtaining a radial force. This means that some of the potential energy of each ball is transformed to kinetic energy, which is utilized for the grinding by compression and/or impact and shearing. However, a great deal of the potential energy is lost when the ball strikes the sloping surface C.

As explained above, the conventional grinding apparatus, i.e., the vertical ball mills, have a problem in that the energy given to the grinding apparatus is not effectively utilized for the grinding by compression and/or impact and shearing, but is consumed to a great extent as heat energy, that is, the energy effect for grinding is low.

SUMMARY OF THE INVENTION

An object of the present invention is to provide an improved grinding apparatus of a new centrifugal fluidization type attaining a considerably high energy efficiency for the grinding.

According to the present invention, there is provided a centrifugal fluidized grinding apparatus comprising a parting vessel composed of an inner vessel part having a vertical axis and symmetrical about the axis and an outer vessel part surrounding the inner vessel part and mounted coaxially with the inner vessel part. The inner vessel part forms a truncated cone converging upwards and has a sloping side surface which is concaved inwardly in a vertically cross-sectional view taken along a plane including the axis. The outer vessel part has an inner side surface which is concaved outwardly in the same vertical cross-sectional view. In combination, the inner side surface of the outer vessel part and the side surface of the inner vessel part form a circumferential groove having a continuous and smooth inner surface connected at the lower edges of both vessel parts. The groove surface has a generally ovoid profile with an upper part thereof cut away, the ovoid having a longitudinal axis intersecting the vertical axis at a position over the inner vessel part in the same vertical cross-sectional view.

The inner and outer vessel parts are mounted so that the inner vessel part is rotated relative to the outer vessel parts. The inner vessel part may be rotated while the outer part remains stationary. Alternatively, the inner and outer vessel parts may both be rotated in opposite directions.

Balls are lodged in the vessel groove as a grinding medium for grinding starting materials such as alumina particles, in cooperation with the vessel per se. Compared with a conventional ball mill involving an integrated rotating vessel where the balls are lodged, as shown in FIG. 2*a* or 2*b*, the apparatus of the present invention allows a tangential velocity difference between each ball and the inner surface of the vessel groove to be increased, since the outer vessel part may be either stationary or rotated in a reverse direction to the rotation of the inner vessel part. Such an increased tangential velocity difference leads to a considerably enhanced grinding effect by compression and/or impact and shearing.

Further, a feature of the present invention is that the balls are forced to fly from the inner concaved surface of the outer vessel part toward the opposite surface, that is, the sloping concaved surface of the inner vessel part, in a parabola, and do not strike the surface but land on the surface in a substantially tangential direction.

Such a tangential landing allows the potential energy of the ball accumulated while the ball creeps up along the surface of the outer vessel part, to be transformed to kinetic energy with a high efficiency, with the result that the energy of the balls is not wasted, i.e., there is little loss of energy.

According to the present invention, massive materials such as slag, portland cemented clinkers, lime stone, coals, mica, ceramics such as alumina, and so on can be effectively ground.

DESCRIPTION OF THE PREFERRED EMBODIMENTS

Figure 1:
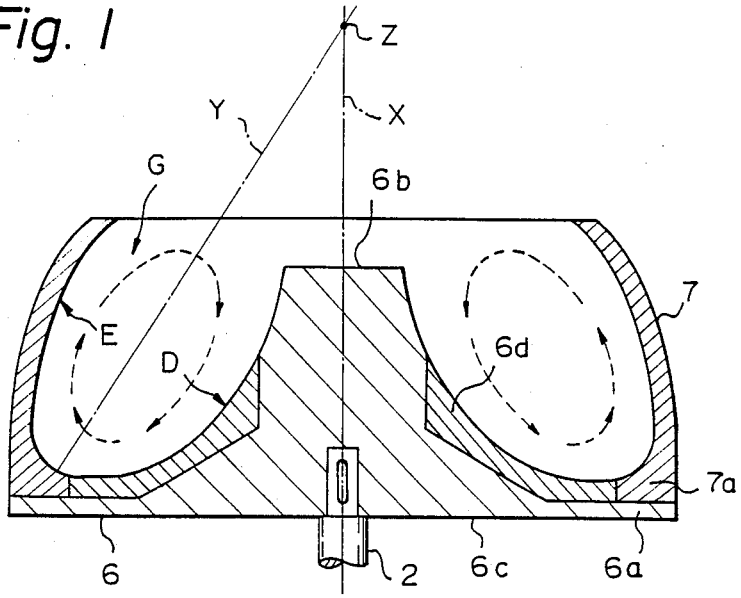
FIG. 1 is a vertical cross-sectional view of a parting vessel incorporated in a grinding apparatus of the present invention.
Figure 2A:
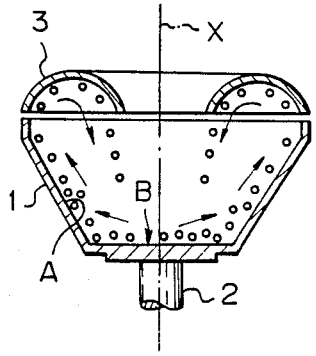
Fig. 2 a PRIOR ART
FIGS. 2*a* and 2*b* are vertical cross-sectional views of integrated vessels with covers, incorporated in conventional grinding apparatuses, respectively.
Figure 2B:
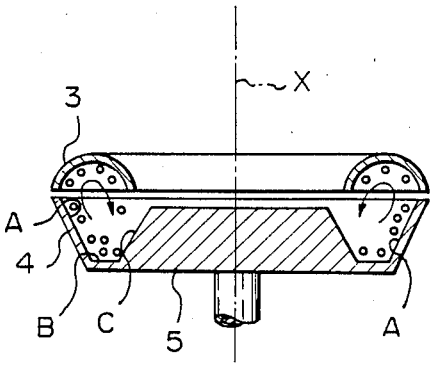
Fig. 2 b PRIOR ART

Referring to FIG. 1, a grinding apparatus of a centrifugal fluidization type according to the present invention comprises a parting vessel 6 symmetrical about the vertical axis X thereof. The parting vessel 6 comprises a rotational inner part or rotor part 6*a* and a stationary outer part or stator part 7, both combining to define a circumferential groove G therebetween. The inner vessel part 6 generally forms a truncated cone projecting upwards, and a circumferential edge portion 6*a* horizontally extending radially outwards, a constricted top surface 6*b*, an enlarged bottom surface 6*c*, and a circumferential sloping side surface D defined between the edge portion 6*a* and the top surface 6*b*. The sloping as the center of the diameter moves downwards along the vertical axis X, so that it is concave in a sectional view taken along a vertical plane including the axis X. The inner vessel part 6 is provided with a liner 6*d* forming a main zone of the sloping side surface D, whereat the balls are likely to slide down. The lower edge portion 6*a* and an upper zone of the sloping surface D are outside the liner 6*d*.

The outer vessel part 7 forms a circumferential wall surrounding the inner vessel part 6 and having a vertical diameter which decreases as the center of the diameter moves upwards, so that an inner surface E of the wall is concave in a sectional view taken along a vertical plane including the axis. The outer vessel part 7 has a circumferential lower edge portion extending horizontally and radially inwards. Preferably, the outer vessel part 7 has a liner forming an overall inner surface. The inner and outer vessel parts 6, 7 are in slidable contact at their lower horizontal edge portions 6*a*, 7*a*, in such a manner that the lower edge portion 7*a* rests on the counter part 6*a*. In this connection, the circumferential groove G defined in the parting vessel 6, 7 has a smooth and continuous inner surface consisting of the surfaces D and E and forming an ovoid with the top portion thereof cut away in a sectional view taken along a vertical plane including the axis. The ovoid has a longitudinal axis Y intersecting the vertical axis X of the vessel at a position Z over the top surface 6*b* of the inner vessel part 6.

Figure 4:
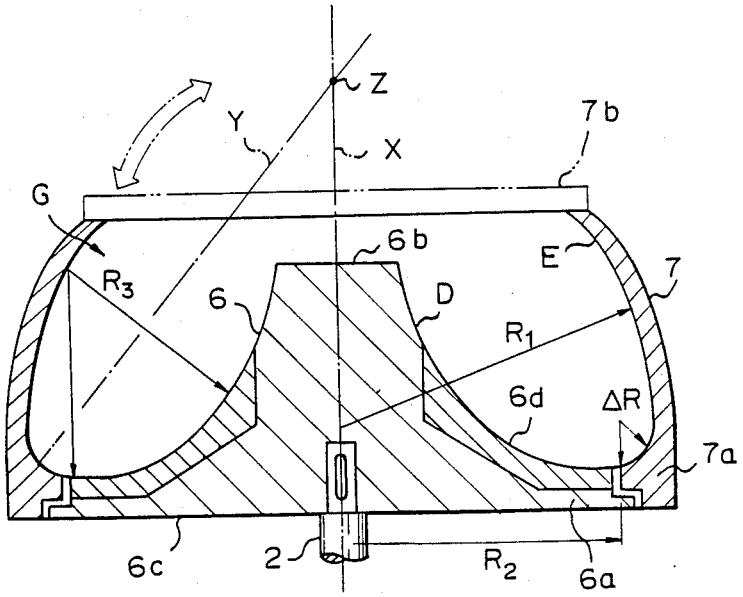
FIG. 4 is a vertical cross-sectional view of a batch-type apparatus according to the present invention.

The inner vessel part 6 is provided with a driving shaft 2 extending downwards from the bottom surface 6*c* along the vertical axis. As shown in FIG. 4, a circumferential clearance may be provided between the lower edge portions 6*a*, 7*a* of the vessel, in a range of from 10 to 30% of the minimum diameter of the balls.

With the above arrangement, the balls are lodged in the groove G formed by the surfaces D and E and materials to be ground then added there. The inner vessel part 6 is rotated, with the added materials, by the driving shaft 2. Accordingly, the balls are forced to move radially outwardly by the centrifuged force generated by rotation of the other surface D, with the result that the balls are forced to creep up and along the stationary surface E due to the kinetic energy of the balls, and then fly in a parabolic manner from the stationary surface E to land smoothly on the rotating surface D in a tangential direction. The landed balls are the forced to descend along the rotating surface D to complete one cycle of the ball movement in a sectional view taken along a vertical plane including the axis. This revolution cycle of each ball is continuously repeated while the inner vessel part 6 is rotating.

Further, during the rotation of the inner vessel part 6, the balls are forced to move circumferentially at a velocity less than the speed of rotation of the inner vessel part 6 in another sectional view taken along a horizontal plane perpendicular to the vertical axis. As a whole, the balls are concurrently subjected to two kinds of the revolutions, i.e., a first revolution in a sectional view taken along a vertical plane including the vertical axis and a second revolution around the inner vessel part 6 (similar to the revolution of the earth around the sun) in a sectional view taken along a horizontal plane perpendicular to the vertical axis.

The combination of the first and second revolutions forces each ball to exhibit a helically revolutional movement around the inner vessel part 6 in the circumferential groove G, similar to the profile of the helical twists forming an element of a rope. This helically revolving movement of the ball just like the rope element twisting movement to form a rope is referred to herein as "centrifugal fluidization".

With the centrifugal fluidization of the balls, while the outer vessel part 7 having the surface E is stationary, a velocity combined by the circumferential velocity of the ball revolving around the surface D with the velocity of the ball creeping up along the surface E is equivalent to a difference in velocity between the ball and the surface E. In this connection, then the outer vessel part 7 is forced to rotate in a reverse direction relative to the inner vessel part 6, this difference in velocity between the ball and the moving surface E is increased. The increased difference enhances the effect of the grinding by compression and/or impact and shearing.

The energy loss of each ball due to the collision against the surface D is a very small, since the ball lands tangentially at the surface D and descends smoothly along the surface D while rotating. Due to the descending movement of the ball on the concave surface D, the potential energy of the ball obtained while the ball rises along the surface E is transformed to kinetic energy, forcing the ball to move radially outwards. In this connection, there is little waste of the energy once given to the ball, and thus this energy can be effectively utilized for the grinding operation.

In addition, the materials are effectively shear-ground while the balls are descending along the surface D, since the balls are forces to slide against the surface D.

In the centrifugal fluidized grinding apparatus of the present invention, the rotation speed of the inner vessel part 6 may be constant. Alternatively, the rotation speed may be varied in either a regular or constant mode or an irregular or pulse mode. This variation of the rotation speed causes an irregular movement of the balls, and thus the shear-grinding is improved.

Figure 3A:
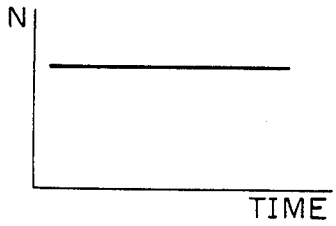
FIGS. 3*a* to 3*e* are diagrams showing various modes of rotation speeds applicable for a rotary vessel part of the grinding apparatus as shown in FIG. 1, respectively.
Figure 3B:
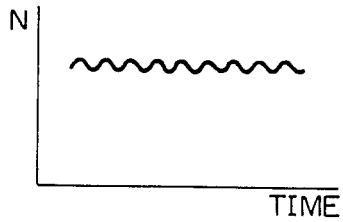
Figure 3C:
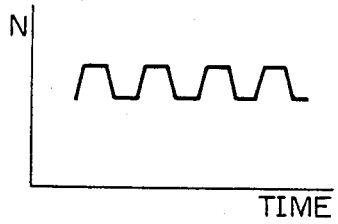
Figure 3D:
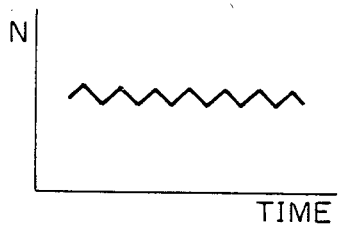
Figure 3E:
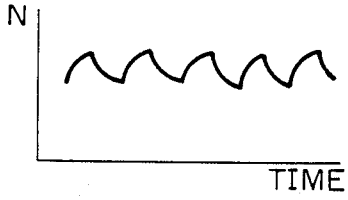

FIG. 3*a* to FIG. 3*e* show the variations of the rotation speed N which can be applied to the above inner vessel part 6. The inner vessel part 6 may be rotated at a constant rotation speed N as shown in FIG. 3*a;* at a varying speed in a sine curve fashion as shown in FIG. 3*b;* at a speed varying with a cycles pattern where N is higher value for a period of time and then a lower value for another period of time as shown in FIG. 3*c;* at a varying speed in a saw-toothed fashion having a cycled pattern, where N increases to a higher level and then decreases to a lower level at the same pace, as shown in FIG. 3*d;* and at a varied speed in a modified saw-toothed fashion having a cycled pattern, where N increases gradually to a high level and then decreases rapidly to a lower level as shown in FIG. 3*e.*

Further, research by the inventors shows that the side surfaces D and E having concaved profiles, in a sectional view taken along a vertical plane including the axis, and forming segments of circles, respectively, as shown in FIG. 4, provide, in combination, an enhanced grinding performance. In FIG. 4, $R_1$ and $R_3$ are radii of curvatures of the surfaces E and D, respectively. The lower edge portion 7*a* of the outer vessel part 7 has an inner radius $R_2$ at the inner end thereof. Preferably, the edge portion 7*a* is provided with a concaved inner surface having a radius of curvature $\Delta R = R_1 - R_2$, since this will ensure a smooth connection between the inner surface and the surface E.

The apparatus of the present invention may be designed for grinding by a continuous process or a batch process. A batch type apparatus may be provided with a cover 7*b* as shown in FIG. 4, and a continuation type apparatus may be the same as that shown in FIG. 5.

Figure 5:
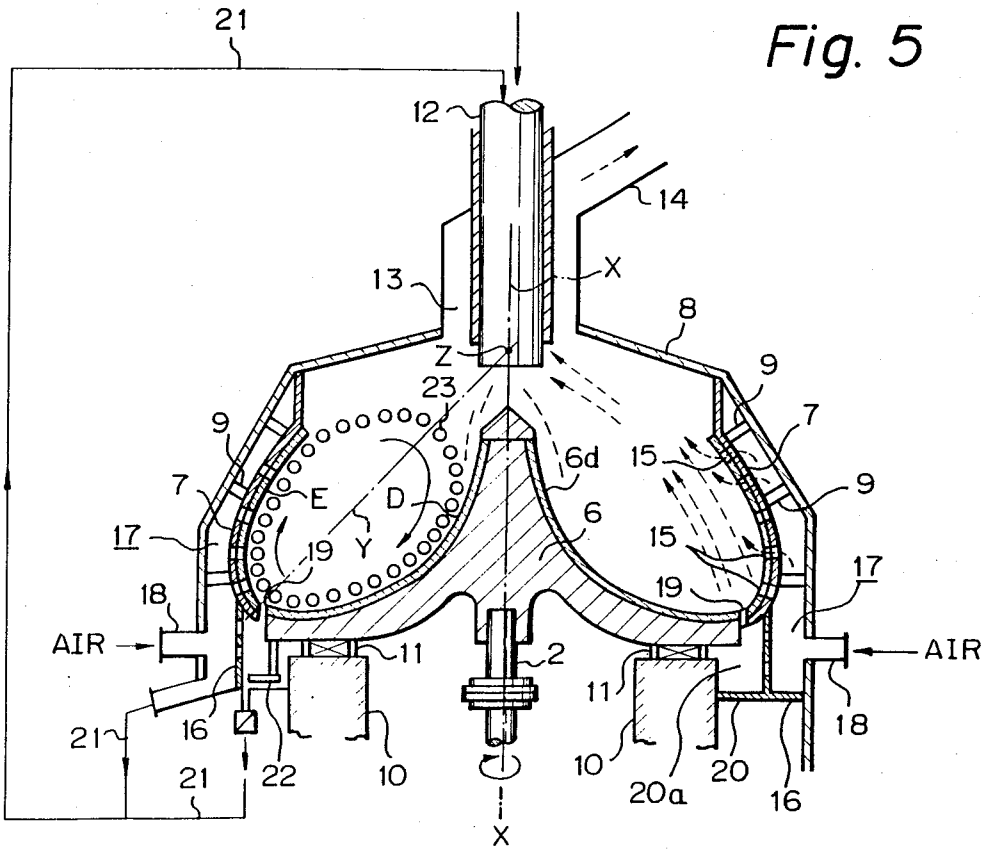
FIG. 5 is a vertical cross-sectional view of a continuation-type apparatus according to the present invention, wherein a parting vessel is incorporated.

Referring to FIG. 5, the continuation type apparatus of the present invention comprises a parting vessel composed of inner and outer vessel parts 6 and 7, which are substantially the same as those in FIG. 1, and a bottomless casing 8 which is substantially symmetricâl about the axis and which covers the vessel. The outer vessel part 7 is connected to the casing 8 by a connecting member 9, and the inner vessel part 6 having a drive shaft 2 is rotatably supported on a cylindrical support 10 through a bearing 11. The drive shaft 2 is connected to a motor via a transmission mechanism.

The casing 8 has a ceiling portion covering the vessel per se, and this ceiling portion has an opening 13 at the center thereof. A duct 14 is mounted on the casing 8 to communicate with the interior of the vessel through the opening 13. A feed conduit 12 for the materials to be ground is provided such that it is located in the opening 13 and extends upwards along the vertical axis from the ceiling portion of the casing 8, passing through a hole formed in the duct 14. The outer vessel part 7 has a liner forming an inner surface E, and a plurality of narrow slits or small holes 15 formed over the surface E. A circumferential cover 16 extends axially or vertically and is connected to the outer vessel part 7 and the casing 8 at the lower ends thereof so that an air feed chamber 17 is defined by the cover 16, the inner surface of the casing 8 and the outer surface of the outer vessel part 7. An air feed conduit 18 is provided to communicate with the interior of the chamber 17.

A circumferential clearance 19 is formed between the inner and outer vessel parts 6, 7 at the lower edges thereof. This clearance 19 is spaced horizontally at a distance in the range of 10 to 30% of the minimum diameter of balls 23.

A circumferential bottom cover 20 extends radially and is provided to close a circumferential opening formed at the bottom of the casing 8 between the casing 8 and the circumferential support 10. The vertically or axially extending cover 16 is connected to the radially extending cover 20, so that the support 10 with the bearing 11, the radially extending cover 20, the axially extending cover 16, the outer vessel part 7, and the inner vessel part 6, in combination, form a local circumferential chamber 20*a* with which the interior of the vessel is communicated through the clearance 19. In this embodiment, the axially extending cover 16 is perforated so that air can be fed into the local chamber 20*a* from the chamber 17.

The chambers 17 and 20*a* have outlets communicating with a conduit line 21 for removing or transporting the ground particles from the system and recycling the same thereto. A scraper 22 is mounted at the inner vessel part 6 at the lower edge portion thereof, so that it can revolve as the inner vessel part 6 rotates and scrapes the ground materials, which have fallen from the vessel into the local chamber 20*a* through the clearance 19, toward the opening of the axially extending cover 20.

The recycling conduit line 21 is connected to the feed conduit 12. The duct 14 is connected to a means for collecting the ground particles, including a bag filter (not shown). A means for classifying the ground materials may be provided upstream of the collecting means.

With the above mentioned apparatus of the present invention, starting material particles of alumina, mica or the like are supplied through the feed conduit 12 into the vessel, where balls as a grinding agent or medium having sizes preferably from 3 to 70 mm are lodged in advance. The inner vessel part 6 is forced to rotate by the drive shaft 2 with a rotation speed N in the range of 200 to 3000 r.p.m., while the outer vessel part 7 remains stationary. During the rotation, the starting material particles encounter the balls subjected to the "centrifugal fluidization" or the helical revolving movement as explained with reference to FIG. 1 in the vessel.

Air is forced to flow into the air feed chamber 17 and then into the local chamber 20*a*, and the flow into the vessel from both chambers 17 and 20 through the slits or holes formed in the outer vessel part 7 as well as the clearance 19 between the inner and outer vessel parts 6, 7. The air fed as above is forced to flow out of the vessel, carrying the ground fine particles, into the duct 14 and thus carries the fine particles toward the classifying means and/or collecting means. The fine particles, having passed out of the vessel through the narrow slits or small holes 15 and the clearance 19, and received in the chambers 17 and 20*a*, are then forced to return to the vessel through the conduit line 21.

Some other gas such as $N_2$ or Ar may be substituted for the air as needed.

If a classifying means is provided in the line connected to the duct 14, larger size particles are classified and returned t the vessel through the feed conduit 12.

Figure 6:
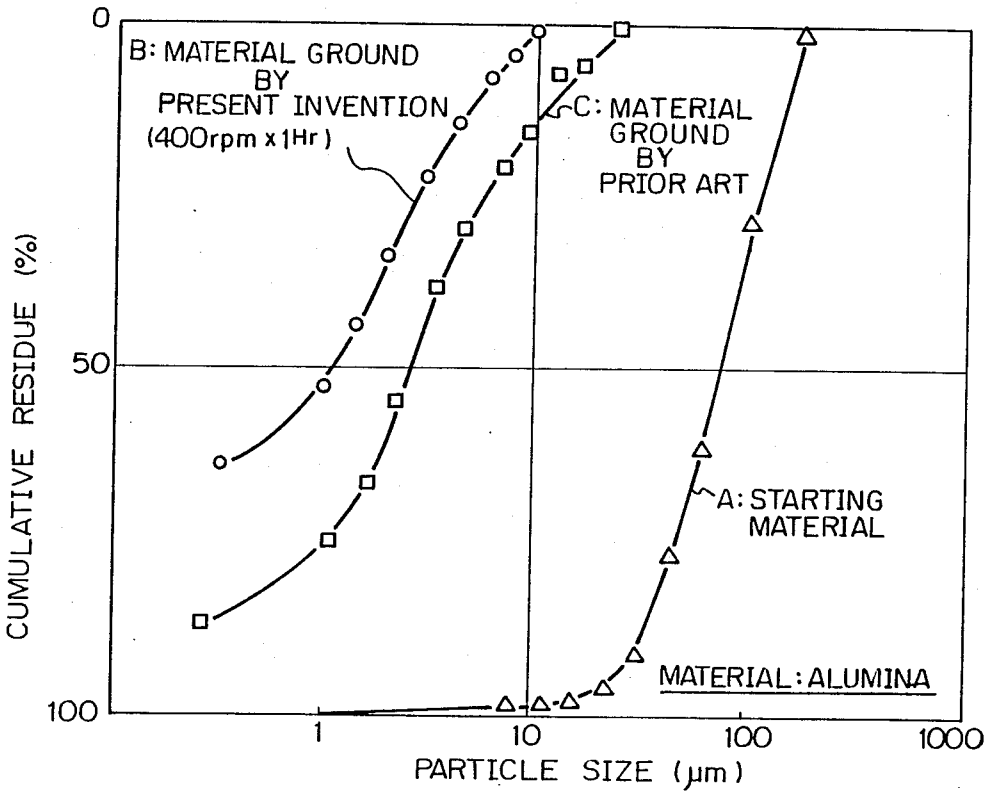
FIGS. 6 and 7 are diagrams showing particle size distributions of starting materials, and the resultant materials ground by a conventional apparatus and those ground by the present invention, as a comparison.
Figure 7:
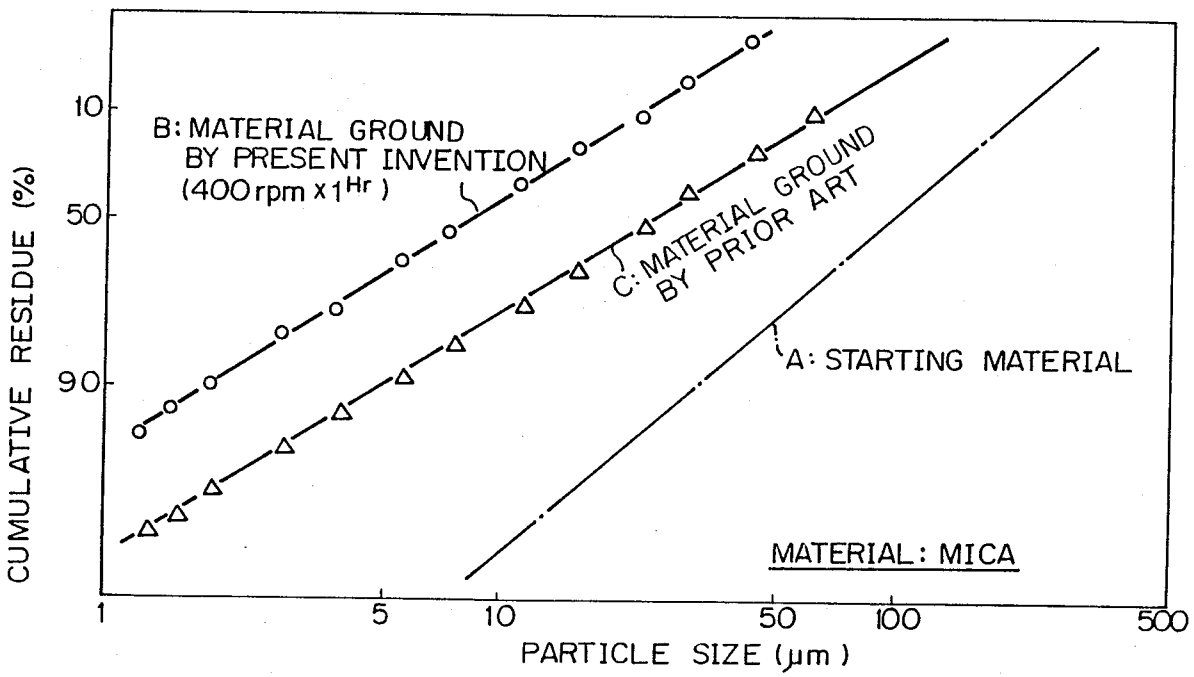

FIGS. 6 and 7 are diagrams showing a comparison of particle size distributions of alumina and mica ground for one hour by the apparatus of the present invention at a rotation speed of 400 r.p.m., and by a conventional ball mill. In FIG. 6 and FIG. 7, the horizontal axis indicates particle sizes ($\mu$m) and the vertical axis indicates cumulative residue (%). A denotes a size distribution of starting material particles (alumina in FIG. 6 and mica in FIG. 7), B denotes a size distribution of particles ground by the apparatus of the present invention, and C denotes a size distribution of particles ground by the conventional ball mill.

The diagrams of FIG. 6 and FIG. 7 both show that the curves of the size distributions B are substantially shifted horizontally the left or smaller size zones with respect to the curves of the size distributions C, respectively, and thus it is clear that the grinding effect of the present invention is superior to that of the prior art.

The centrifugal fluidization type grinding apparatus according to the present invention has the following features in comparison with a conventional grinding apparatus.

A conventional lateral type grinding apparatus such as a lateral ball mill is inoperative in practice over a critical rotation speed of a drum, since a grinding medium such as steel balls is forced to revolve together with the inner surface of the drum, that is substantially stationary relative to the drum surface, when the rotation speed of the drum is higher than the critical valve. A mixing mill and a tower mill are also inoperative in practice at a high rotation speed, since each is provided with a mixing bar or a rotational blade moving against the balls in such a manner that the bar or blade divides the balls into two groups, and thus the higher the rotation speed the greater the resistance of the balls against the bar or blade.

In marked contrast, theoretically, in the grinding apparatus of the present invention, the inner vessel part 6 can rotate at an unlimited high speed relative to the outer vessel part 7. Of course, it is meaningless to increase the rotation speed over a certain speed from the view points of economy and technology. The critical speed, however, is considerably higher than those of the ball mill, the mixing mill and the tower mill. In this connection, the helical revolving movement of the balls produces a very high velocity of the balls, and this high speed helical revolving movement of the balls is very advantageous when carrying out a grinding operation. In other words, a velocity of the balls relative to the surface E of the outer vessel part 7 can be very high, with the result that the grinding effect is greatly improved. Further, since the kinetic energy and the potential energy of the balls having landed tangentially on the inner vessel part are transformed to only kinetic energy, to cause the balls to move radially, any loss of the energy at the vessel is considerably reduced. Further an additional grinding performance is obtained with the balls sliding on the surface D of the inner vessel part 6.

As a result, according to the present invention, the grinding efficiency is greatly increased, while a power energy needed per a unit material, i.e., unit power (for example, a unit of electric power) is greatly decreased.

We claim:

1. A centrifugal fluidized grinding apparatus comprising: a parting vessel in which balls as a grinding medium and starting materials to be ground are lodged, the parting vessel comprising inner and outer vessel parts having a common vertical axis, the inner vessel part forming generally a truncated cone having an inwardly concave circumferential side surface, the outer vessel part forming a circumferential wall surrounding the inner vessel part and having an outwardly concave inner side surface, both the vessel parts being mounted for relative rotation about the axis and adjacent to each other at the lower edges thereof so that opposite concave side surfaces thereof define a circumferential groove between both vessel parts, the circumferential groove having a continuous and smooth surface and providing a completely open inner space allowing the grinding medium and starting materials to move freely through any part of the entire area of the inner space without encountering any obstacles; and means for driving the parting vessel so that the inner vessel part rotates relative to the outer vessel part.

2. A centrifugal fluidized grinding apparatus according to claim 1, wherein the circumferential groove has a generally ovoid profile with an upper part thereof cut away in a vertical cross-sectional view taken along a plane including the vertical axis, the ovoid having a longitudinal axis intersecting the vertical axis at a position over the parting vessel.

3. A centrifugal fluidized grinding apparatus according to claim 1, comprising a cover for the parting vessel detachably mounted on the outer vessel part at the upper edge thereof, the cover and the parting vessel having the groove form in combination, a chamber wherein a batch grinding process is carried out with the balls, which fly from the inner side surface of the outer vessel part to land tangentially on the opposite side surface of the inner vessel part in a parabolic flight course below the lower or ceiling surface of the cover, when the inner vessel part is in rotation relative to the outer part.

4. A centrifugal fluidized grinding apparatus according to claim 1, further comprising a casing for housing said parting vessel, the casing having a material feed inlet and an outlet for ground materials at a top part of the casing and at least one air feed inlet disposed at a lower part of the casing, the outer vessel part being perforated to permit the air from said at least one air inlet to be fed into the interior of the parting vessel, the casing and the parting vessel forming a chamber wherein a grinding process is carried out with the balls wherein the inner vessel part rotates relative to the outer vessel part said balls flying from the inner side surface of the outer vessel part to land tangentially on the opposite side surface at the inner vessel part in a substantially parabolic flight course below the upper surface of the casing.

5. A centrifugal fluidized grinding apparatus according to claim 4, wherein a conduit line is provided at a lower part of the casing and communicates with the material feed inlet for recycling the ground materials passed out through the perforated vessel wall into the groove.

6. A centrifugal fluidized grinding apparatus according to claim 5, wherein the adjacent lower edges of the inner and outer vessel parts form a circumferential clearance therebetween, the clearance being spaced at a distance in the range of 10 to 30% of the minimum diameter of the balls, and wherein means for covering the clearance are provided to form a circumferential chamber below the parting vessel, the covering means being perforated to communicate the circumferential chamber with the recycling conduit line.

7. A centrifugal fluidized grinding apparatus according to claim 6, wherein the circumferential chamber has an outlet at the bottom thereof to communicate with the conduit line, and a scraper extending downwards from the inner vessel part is provided in the circumferential chamber so as to scrape the ground materials fallen from the clearance toward the outlet of the circumferential chamber, while the scraper rotates with the inner vessel part.

8. A centrifugal fluidized grinding apparatus according to any one of claims 2, 3, 4, 5, 6, 7, or 1, wherein the inner vessel part is provided with a drive shaft for rotation extending axially downwards from the bottom thereof, while the outer vessel part is stationary, wherein the inner vessel part as a rotor is forced to rotate at a constant or pulsed rotation speed.

9. A centrifugal fluidized grinding apparatus according to claim 8, wherein the inner vessel part is provided with a liner forming a main zone of the side surface where the balls are likely to slide down.

10. A centrifugal fluidized grinding apparatus according to any one of claims 2, 3, 4, 5, 6, 7, or 1, wherein the inner and outer vessel parts are provided with separate means for rotation so that said parts are forced to rotate in opposite directions.

11. A centrifugal fluidized grinding apparatus according to claim 10, wherein the inner vessel part is provided with a liner forming a main zone of the side surface where the balls are likely to slide down.

12. A centrifugal fluidized grinding apparatus comprising: a parting vessel in which balls as a grinding medium and starting materials to be round are lodged, the parting vessel comprising inner and outer vessel parts having a common vertical axis, the inner vessel part forming generally a truncated cone having an inwardly concave circumferential side surface, the outer vessel part forming a circumferential wall surrounding the inner vessel part and having an outwardly concave inner side surface, both the vessel parts being mounted for relative rotation about the axis and adjacent to each other at the lower edges thereof so that opposite concave side surfaces thereof define a circumferential groove between both vessel parts, the groove having a continuous and smooth surface; means for driving the parting vessel so that the inner vessel part rotates relative to the outer vessel part; a casing for housing the parting vessel, the casing having a material feed inlet and an outlet for ground materials disposed at a top part of the casing and at least one air feed inlet disposed at a lower part of the casing, the outer vessel part being perforated to permit air from said at least one air inlet into the interior of the parting vessel, the casing and the parting vessel forming a chamber wherein a grinding process is carried out with the balls whenever the inner vessel part rotates relative to the outer vessel parts, said balls flying from the inner side surface of the outer vessel part to lane tangentially on the opposite side surface of the inner vessel part in a substantially parabolic flight course below the upper surface of the casing.

13. A centrifugal fluidized grinding apparatus according to claim 12, wherein a conduit line is provided at a lower part of the casing and communicates with the material feed inlet for recycling the ground materials having passed out through the perforated vessel wall into the groove.

14. A centrifugal fluidized grinding apparatus according to claim 13, wherein the adjacent lower edges of the inner and outer vessel parts from a circumferential clearance therebetween, the clearance being spaced at a distance in the range of 10 to 30% of the minimum diameter of the balls, and wherein means for covering the clearance are provided so as to form a circumferential chamber below the parting vessel, the covering means being perforated to communicate the circumferential chamber with the recycling conduit line.

15. A centrifugal fluidized grinding apparatus according to claim 14, wherein the circumferential chamber has an outlet at the bottom thereof to communicate with the conduit line, and a scraper extending downwards from the inner vessel part is provided in the circumferential chamber so as to scrape the ground materials fallen from the clearance toward the outlet of the circumferential chamber, while the scraper rotates with the inner vessel part.

16. A centrifugal fluidized grinding apparatus according to any one of claims 12 to 15, wherein the inner vessel part is provided with a drive shaft for rotation extending axially downwards from the bottom thereof, while the outer vessel part is stationary, wherein the inner vessel part as a rotor is forced to rotate at a constant or pulsed rotation speed.

17. A centrifugal fluidized grinding apparatus according to claim 16, wherein the inner vessel part is provided with a liner forming a main zone of the side surface where the balls are likely to slide down.

18. A centrifugal fluidized grinding apparatus according to any one of claims 12 to 15, wherein the inner and outer vessel parts are provided with separate means for rotation so that said parts are forced to rotate in opposite directions.

19. A centrifugal fluidized gringing apparatus according to claim 18, wherein the inner vessel part is provided with a liner forming a main zone of the side surface where the balls are likely to slide down.

* * * * *